United States Patent [19]

Olsson

[11] Patent Number: 4,845,448

[45] Date of Patent: Jul. 4, 1989

[54] ARRANGEMENT IN WAVE GUIDE FLANGES

[75] Inventor: Kurt G. Olsson, Kungälv, Sweden

[73] Assignee: Telefonaktiebolaget L M Ericsson, Stockholm, Sweden

[21] Appl. No.: 176,688

[22] Filed: Apr. 1, 1988

[30] Foreign Application Priority Data

Apr. 13, 1987 [SE] Sweden ..... 8701538

[51] Int. Cl.[4] ..... H01P 1/04

[52] U.S. Cl. ..... 333/254; 285/408

[58] Field of Search ..... 333/248, 254; 29/600; 285/405–408, 413; 403/335, 336

[56] References Cited

U.S. PATENT DOCUMENTS

| | | | |
|---|---|---|---|
| 2,755,112 | 7/1956 | Klancnik | 285/405 |
| 2,906,975 | 9/1959 | Donohue et al. | 333/254 |
| 3,972,013 | 7/1976 | Shapiro . | |
| 4,638,273 | 1/1987 | Foglesonger et al. | 333/254 |

FOREIGN PATENT DOCUMENTS

| | | |
|---|---|---|
| 2125655 | 9/1972 | France . |
| 2237102 | 2/1975 | France . |
| 925279 | 5/1963 | United Kingdom . |

*Primary Examiner*—Paul Gensler

*Attorney, Agent, or Firm*—Burns, Doane, Swecker & Mathis

[57] ABSTRACT

An arrangement is provided for attaching a flange (4) to a wave guide (1) and comprises a flange (4), a further flange (2) and a locking member (3) in the form of a frame or ring for respectively a rectangular or circular wave guide. The locking member (3) is placed between the flanges (2,4). The flange (4) has a wall (46) of a recess (45) such that when both flanges are fastened to the wave guide (1) and to each other, the locking member (3) penetrates a distance into the wave guide wall, thereby locking the flanges (2,4) to the wall.

2 Claims, 1 Drawing Sheet

ARRANGEMENT IN WAVE GUIDE FLANGES

TECHNICAL FIELD

The present invention relates to an arrangement for attaching a flange to a wave guide, the cross section of which can either be rectangular or circular. The attached flange is intended to be used as a coupling member in coupling several wave guide sections together.

BACKGROUND ART

Flanges attached to the wave guide ends are usually used in coupling two wave guides to each other. The wave guides are finally coupled together by connecting the flanges, using a bolted connection. A problem here is how the flange in its turn is to be fastened to the wave guide.

A known method of attaching a flange to a wave guide is by brazing when the flange is made from brass or by dip brazing when it is made from aluminium. These methods are expensive, however.

It is already known to mechanically attach the flange to the wave guide, for example, the GB-B No. 1.025.928 teaches an attachment where the flange is provided with a muff which can glide along the outer wall of the wave guide when it is applied. For attachment, the flange is adjusted so that the grooves in the muff are directly opposite depressions in the wave guide wall. Rectangular pins are then pressed in, which are firmly wedged in the muff of the flange as well as in the depressions, thus fixing the flange to the wave guide wall.

Another method of mechanically attaching a flange to a wave guide is illustrated in GB-B No. 1.302.133. Here the flange has a rectangular opening part with a bore in each corner thereon. After the flange has been fitted to the wave guide, hollow screws are driven into the bores and then pins are driven into the screws, which expand and lock the flange to the wave guide.

DISCLOSURE OF INVENTION

The present invention is based, as with the above-mentioned, known structures, on mechanically clamping the flange to the outer wall of the wave guide, and has the object of providing a secure and cheap attachment. The main principle of the arrangement in accordance with the invention is that the wave guide flange comprises two parts and a locking member. The parts are attached such that the locking element grips round the wave conductor and locks it between the wave guide flange parts. The arrangement is characterized by the disclosures in the accompanying claims.

BRIEF DESCRIPTION OF DRAWINGS

The arrangement in accordance with the invention will now be described in more detail with reference to the accompanying drawing, where.

BEST MODE FOR CARRYING OUT THE INVENTION

Figure 1:
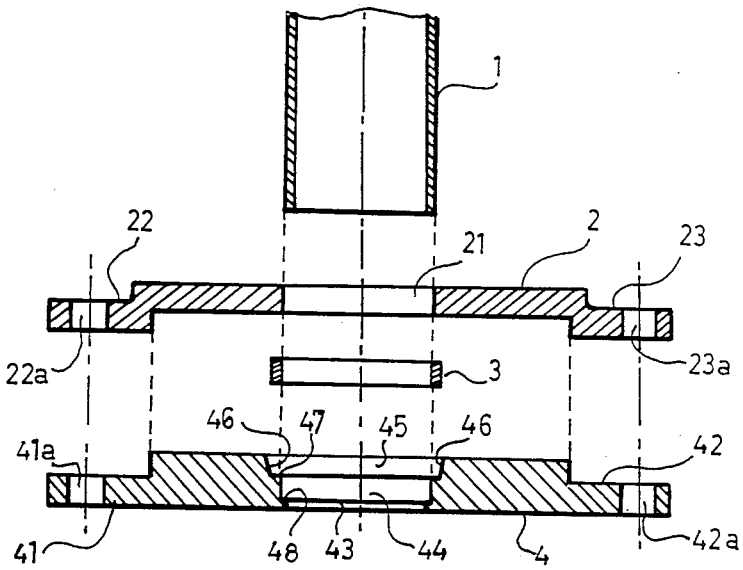
FIG. 1 is an exploded cross section of the parts in the arrangement before assembling on a wave guide and FIG. 2 is the same cross section with the parts in the arrangement in their finally assembled state on the wave guide.

A wave guide with a rectangular or circular cross section and of a known kind is denoted by the numeral 1 in FIG. 1. The proposed arrangement comprises three parts, namely two flanges 2, 4 and a locking member 3. The inward flange 2 is a compression flange and has an opening 21 of the same shape as the wave guide opening, e.g. rectangular, but of such dimensions that the flange 2 can be forced or eased onto the wave guide (see also FIG. 2). The flange 2 further has two outer portions 22, 23 with bored holes 22*a*, and 23*a*.

The outer flange 4, which constitutes the wave guide flange proper for coupling to other wave guides, has two outer portions 41, 42 with associated bored holes 41*a*, 42*a* as with the flange 2. The flange 4 has an opening comprising three rectangular parts 43, 44, and 45 of different dimensions but with a common centre line coinciding with the centre line of the rectangular opening 21 in the flange 2. The opening part 43 is the opening towards the unillustrated wave guide which is to be coupled to the wave guide 1. The opening part 44 has corresponding dimensions to the opening 21 and shall engage against the outer wall of the wave guide. The opening part 45 has somewhat larger dimensions than those of the opening part 44 and is formed with a bevelled wall 46 which tapers some few degrees, e.g. 3°–5°, towards the centre line (the symmetrical axis of flanges 2 and 4).

The third part of the arrangement in accordance with the invention is a locking member, in this case in the shape of a rectangular frame 3 placed between both flanges 2 and 4 according to FIG. 1. The inner dimensions of the locking member 3 are suited to the outside dimensions of the wave guide 1, while its outside dimensions correspond to the opening 45. The wall thickness of the frame 3 is thus approximately as great as the width of the bottom 47 of the opening part 45.

Figure 2:
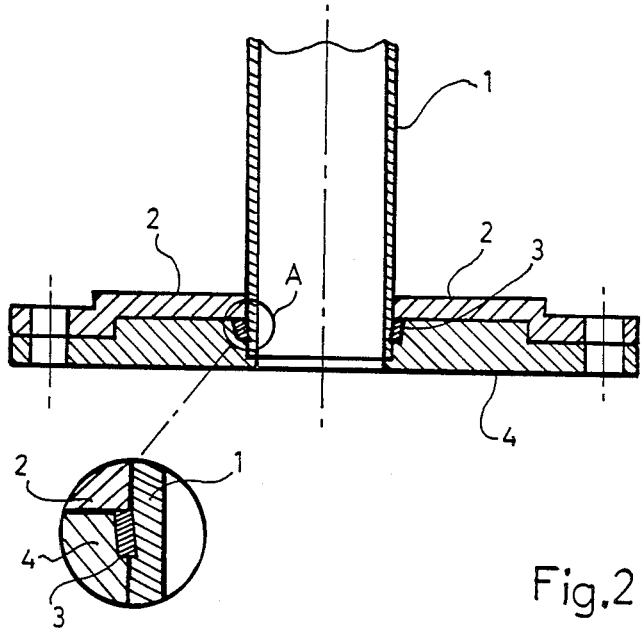

FIG. 2 illustrates the arrangement in its finally assembled state where the flange 2, locking member 3 and flange 4 have been pushed onto the end of the wave guide and where flange 4 has been fastened and pressed to the flange 2 with the aid of unillustrated nuts and screws through the holes 22*a*, 41*a*; 23*a*, 42*a*. With the flanges 2 and 4 pressed together, the inmost part of flange 2 will engage against the upper engagement surface of the locking member 3, and since the width of the locking member is somewhat greater than the width of the bottom 47 of the opening part 45, the lower inner edge part of the locking member will cut into the outer wall of the wave guide 1. With the meeting surfaces of both flanges 2 and 4 fully, mutually engaged as illustrated in the detail enlargement A, the locking member 3 is pressed a distance into the wave guide wall and the wave guide itself has been pressed against the bottom 48 of the opening part 44 of the flange 4 so that the outer edge surface of the wave guide engages against the bottom 48. There is thus obtained a fixed and secure attachment of the outer flange 4 to the wave guide 1.

The locking member 3 does not need to be formed as a rectangular frame but can comprise of such as two pins of the same thickness as the frame 3. These pins can then be situated one on either side of the wave guide.

I claim:

1. A connector for a waveguide, comprising:

two opposed flanges, each provided with a hole for receiving part of said waveguide, and a complementary surface portion for contacting the complementary surface portion of the opposed flange, one of said flanges being further provided with a non-complementary surface portion proximate said hole for forming a recess between said flanges; and a locking member for insertion in said recess, contact of said complementary surface portions causing said locking member to protrude into said hole of at least one of said flanges.

2. A connector for a waveguide as in claim 1, wherein a wall of a part of said recess formed by said non-complementary surface portion of said one of said flanges is tapered in relation to a wall of said waveguide.

* * * * *